US006560850B2

(12) United States Patent
St. John et al.

(10) Patent No.: US 6,560,850 B2
(45) Date of Patent: May 13, 2003

(54) MICROWAVE WAVEGUIDE ASSEMBLY AND METHOD FOR MAKING SAME

(75) Inventors: Marc St. John, Chevy Chase, MD (US); Barre Lankford, Sykesville, MD (US); Steve Stowell, Mt. Airy, MD (US)

(73) Assignee: Hughes Electronics Corporation, El Segundo, CA (US)

( * ) Notice: Subject to any disclaimer, the term of this patent is extended or adjusted under 35 U.S.C. 154(b) by 113 days.

(21) Appl. No.: 09/825,624

(22) Filed: Apr. 4, 2001

(65) Prior Publication Data

US 2002/0144392 A1 Oct. 10, 2002

(51) Int. Cl.[7] ..... H01P 11/00
(52) U.S. Cl. ..... 29/600; 156/292; 333/239
(58) Field of Search ..... 29/600; 156/292, 156/304.2, 64, 153, 277; 333/239, 248, 240, 241, 242; 138/157, 170

(56) References Cited

U.S. PATENT DOCUMENTS 5,398,010 A * 3/1995 Klebe ..... 156/150
5,578,972 A 11/1996 Hadden et al.

* cited by examiner

*Primary Examiner*—Gregory L. Huson
*Assistant Examiner*—Peter deVore
(74) *Attorney, Agent, or Firm*—John T. Whelan; Michael Sales

(57) ABSTRACT

A waveguide and a method for assembling the same are provided. The waveguide comprises a first half and a second half. A gasket is applied to a first mating surface of the first half. The first mating surface of the first half is aligned with a second mating surface of the second half. The gasket is positioned between the first mating surface of the first half and the second mating surface of the second half. The first half is fastened to the second half to form the assembled waveguide.

25 Claims, 4 Drawing Sheets

MICROWAVE WAVEGUIDE ASSEMBLY AND METHOD FOR MAKING SAME

TECHNICAL FIELD

The present invention relates generally to waveguide assemblies and more particularly, to a method for assembling a waveguide to maintain electrical conductivity between portions of the waveguide.

BACKGROUND OF THE INVENTION

Currently several very small aperture antenna ground based terminals (VSAT), referred to as remote ground based terminals, contain waveguide antenna feeds which permit remote terminals to simultaneously transmit data to and receive data from a satellite with a single directional antenna. The waveguide antenna feed system can be referred to as a Transmit Receive Isolation Assembly (TRIA). A TRIA is an integral self-contained multiple waveguide assembly for coupling a receiver and a transmitter into a single VSAT antenna. VSATs using TRIAs have increased transmission capabilities, reduced part quantity, and reduced costs to assemble and operate over VSATs not using TRIAs.

Due to the intricacies of the TRIA waveguide dimensions a "split block" or "clam shell" manufacturing approach is required in which two halves are used to form the waveguide. The TRIA is comprised of three waveguide microwave circuit sections. The first waveguide section is the circular waveguide section. The second section is the transmitter waveguide section. The third section is the receiver waveguide section. In order for the waveguide sections within the TRIA to receive or transmit appropriately the mating surfaces between a first half and a second half of the TRIA, in the two above approaches, need to be flat and provide a good electrically conductive seal.

Three different methods are commonly used to achieve the electrically conductive seal: soldering the waveguide halves together, brazing the waveguide halves together, and/or lapping or machining the mating surfaces and mechanically fastening the waveguide halves together.

Soldering involves applying solder flux to the first half of the waveguide and applying solder paste to the second half of the waveguide. A mating surface of the first half is then assembled to a mating surface of the second half to form the waveguide. After assembling the first half to the second half to form the waveguide, the waveguide is baked to re-flow solder and create a metal-to-metal bond between the first half and the second half. The waveguide is then cleaned to remove solder flux. The disadvantages to soldering are that soldering is labor intensive and therefore costly. The solder may potentially drip/flow into the waveguide causing the waveguide to fail electrical performance. Furthermore, if the waveguide is not cleaned completely, the solder flux can cause metal corrosion.

Brazing involves applying solder flux to areas where a solder bond is needed. The first half of the waveguide is then assembled to the second half of the waveguide. The waveguide is dipped in a molten metal bath to braze the mating surface of the first half to the mating surface of the second half. Brazing is also labor intensive and therefore costly. In aluminum brazing, the temperature of the molten metal bath is close to the melting point for the waveguide aluminum base metal. Often this causes the waveguide to warp or distort when it is placed in the molten metal bath.

Lapping or machining involves lapping or machining the mating surfaces of each waveguide half to provide a flat mating surface for electrical conductivity and assembling the two waveguide halves with an adequate number of mechanical fasteners. The drawbacks to lapping or machining are that variations to the internal waveguide dimensions are introduced which can cause decreased electrical performance, thereby not meeting electrical requirements such as frequency response, power loss, or rejection requirements. Also because of variation in the mating surfaces the waveguide may require electrical tuning after or during the assembly process. A very flat mating surface prior to machining or lapping each waveguide half is a requirement to minimize lapping variances. If a half is slightly bent coming off the mold, lapping or machining the bend flat can cause significant waveguide dimensional changes and therefore degrade the electrical performance of the waveguide. Lapping and machining are also sensitive to operator performance. Further, if an environmental moisture seal is required for a particular application additional sealing process steps are needed in lapping and machining.

It would therefore be desirable to provide a method of assembling a waveguide that reduces costs, reduces defects, increases performance, increases production quantity for a specified time frame, minimizes steps involved, and removes operator error.

SUMMARY OF THE INVENTION

One object of the invention is to reduce the number of defectively manufactured parts in the assembly method of a Transmit Receive Isolation Assembly (TRIA) contained within a ground based terminal. Another object of the invention is to manufacture a TRIA with less costs and increased performance and production volume.

In one aspect of the present invention a method is provided for assembling a waveguide. The method of assembling a waveguide comprises the steps of: applying a gasket to the mating surface of a first half of the waveguide, fastening the first half to a second half of the waveguide, and disposing the gasket between the mating surface of the first half and a mating surface of the second half.

In a further aspect of the present invention a waveguide is also provided having a first half and a second half. The mating surface of the first half is aligned with the mating surface of the second half. A gasket is disposed between the mating surface of the first half and the mating surface of the second half. The first half is fastened to the second half with a gasket therebetween. The gasket may take the form of a conductive epoxy or a malleable metal pre-form.

One advantage of the present invention, is that there is minimal tolerance variance in waveguide mating surfaces since no lapping or machining occurs to the waveguide halves prior to assembly, therefore no electrical tuning is needed. Another advantage of the invention is that both electrical conductivity and environment moisture seal are obtained with a single automated assembling method. Furthermore, an automated stencil or screen machine can be used to apply a low tolerance, highly repeatable layer of conductive epoxy which creates a bond between the first half and the second half with optimized electrical conductivity. The created bond eliminates the need for strict tolerances on overall flatness on the waveguide first mating surface and the second mating surface, thereby increasing efficiency of production and reducing the number of nonconforming parts. The epoxy also allows the waveguide to be electrically tested before curing, thereby allowing the waveguide assembly to be repaired if the waveguide fails electrical testing. The stencil or screen can also be designed to optimize an environmental moisture seal created by the epoxy that in turn increases the moisture seal production yield (quantity of properly sealed waveguides per time).

Another advantage of this invention is that no hand sealing of the screws, flange faces, or seams is needed which in turn reduces labor costs and improves production yields for moisture sealing. The assembly method is also less sensitive to operator performance over traditional methods. The aforementioned allows for high production quantities.

Therefore, large volume, low cost waveguide assembly is possible due to the stated method advantages. The present invention itself, together with further objects and attendant advantages, will be best understood by reference to the following detailed description, taken in conjunction with the accompanying drawing.

DETAILED DESCRIPTION OF THE PREFERRED EMBODIMENT

Figure 1:
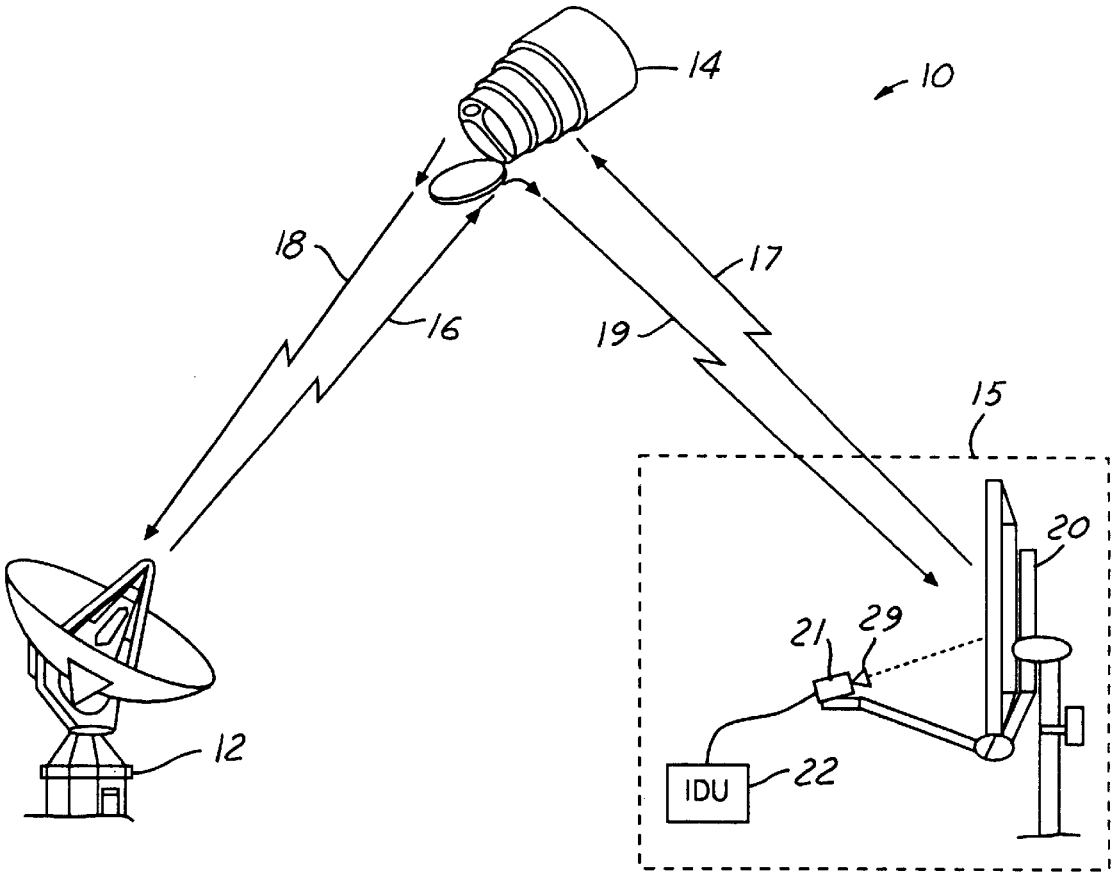
FIG. 1 is a diagrammatic view of a very small aperture terminal satellite (VSAT) communication network, utilizing a Transmit Receive Isolation Assembly (TRIA) assembled according to the present invention.

In the following figures the same reference numerals will be used to refer to the same components. Waveguide components may include but are not limited to: antenna feeds, couplers, power splitters, switches, filters, orthomode transducers, hybrids, diplexers and polarizers. While the present invention is described with respect to an assembly method for producing a waveguide such as Transmit Receive Isolation Assembly (TRIA), the following assembly method is capable of being adapted for various purposes and is not limited to the following applications: a ground based terminal, a satellite, or any other communication device that uses waveguide components.

In the following description various operating parameters and materials are described for one constructed embodiment. These specific parameters and materials are included as examples and are not meant to be limiting.

Referring now to FIG. 1, a block diagamatic view of a very small aperture terminal satellite (VSAT) communication system 10, having a central hub station 12, a communication satellite 14, and a plurality of remote ground based terminals 15. The VSAT network 10 is a data transmission system. Data is transferred between the hub station 12 and the ground based terminals 15 via transponders located in the communication satellite 14. The communication satellite 14 receives uplink signals 16 from the central hub station 12 and uplink signals 17 from the remote ground based terminals 15. The communication satellite 14 transmits downlink signals 18 to the central hub station 12 and downlink signals 19 to the ground based terminals 15. The communication satellite 14 preferably receives signals at a first frequency and transmits signals at a second frequency different from the first frequency.

The remote ground based terminals 15 comprise a small aperture antenna 20 for receiving and transmitting signals, an outdoor unit (ODU) 21 typically mounted proximate an antenna 20 and an indoor unit (IDU) 22 which operates as an interface between specific communication equipment and the ODU 21.

Figure 2:
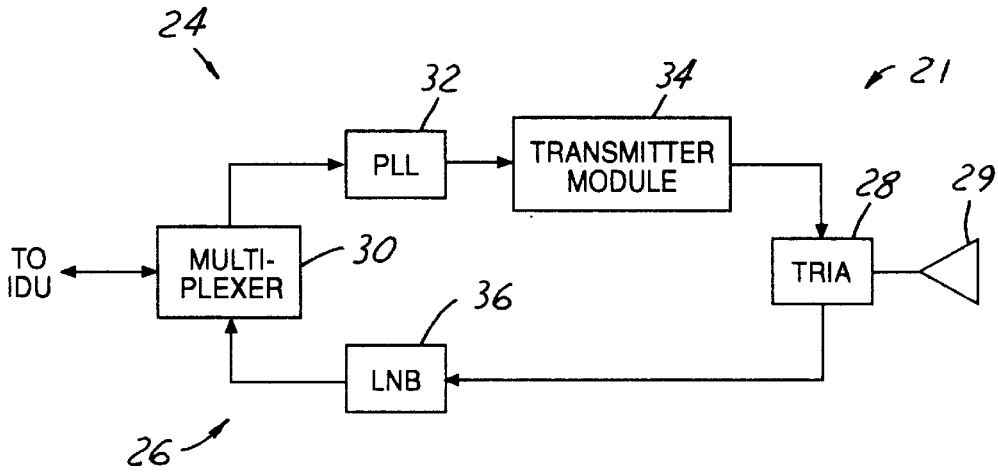
FIG. 2 is a block diagrammatic view of a ground based terminal containing a TRIA assembled according to the present invention.

Referring now to FIG. 2, the ODU 21 comprises a transmitter circuit 24, a receiver circuit 26, and the TRIA 28. A transmitter circuit 24 and a receiver circuit 26 are coupled to the antenna 20 by a TRIA 28 via a feedhorn 29. The transmitter circuit 24 comprises a multiplexer 30 for receiving a modulated data signal from the indoor unit 22, a phase lock loop (PLL) 32 for frequency stabilizing and multiplying the modulated data signal, and a transmitter module 34 for amplifying and frequency multiplying the modulated data signal to generate a modulated carrier signal. The receiver circuit 26 comprises a low noise block down converter (LNB) 36 that transforms the received signal into a corresponding intermediate frequency signal. The intermediate frequency signal is then coupled to the indoor unit 22 via the multiplexer 30. The TRIA 28 is coupled to three communication devices the transmitter module 34 in the transmitter circuit 24, the LNB 36 in the receiver circuit 26, and the antenna 20.

Figure 3:
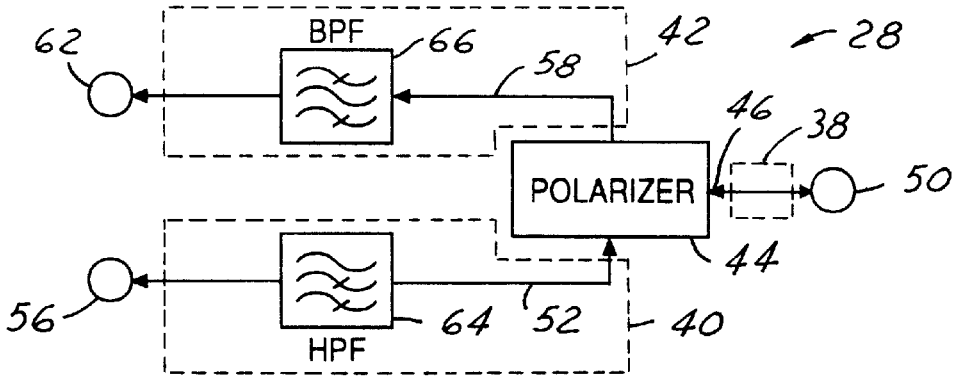
FIG. 3 is a block diagrammatic view of a TRIA according to the present invention.

Referring to FIG. 3, the TRIA 28 allows simultaneous transmission and reception of signals to and from the central hub station 12. The TRIA 28 is an integrally formed unit that comprises essentially a circular waveguide section 38, a transmitter waveguide section (TX) 40, a receiver waveguide section (RX) 42, and a polarizer 44. The TRIA 28 may be produced from but is not limited to any of the following: metal plated plastic, aluminum, plated magnesium, or zinc. The constructed embodiment used type 356 aluminum.

A first port 46 of the circular waveguide section 38 is formed integrally with a first port of the polarizer 44. A second port 50 of the circular waveguide section 38 is coupled to the antenna 20 via feedhorn 29. In the constructed embodiment, the circular waveguide section frequency of operation is between about 10.95 Ghz and about 14.5 GHz. The circular waveguide section may also have a Voltage Standing Wave Ratio (VSWR) of equal to or less than 1.3:1.

The circular waveguide section 38 and the polarizer 44 function as an orthomode transducer. The polarizer 44 functions to couple the linearly polarized signal to the circular waveguide section 38 with regard to the transmission signals. The polarizer 44 also functions to separate the orthogonally polarized transmission signal and received signal, and couple only the received signal to the receiver waveguide section 42.

A first port 52 of the transmitter waveguide section 40 is formed integrally with a second port 50 of the polarizer 44. A second port 56 of the transmitter waveguide section 40 is coupled to the transmitter circuit 24 of the outdoor unit 21 (shown in FIG. 2). The transmitter waveguide section 40 comprises a high pass filter 64 that is integrally formed as part of the transmitter waveguide section 40. The high pass filter 64 functions to attenuate spurious signals generated by the transmitter module 34 that may interfere with normal operation of a receiver (not shown). The high pass filter 64 allows the transmitted signal to comply with communication regulations. In the constructed embodiment, the transmitter waveguide section had a frequency of operation between about 14.0 GHz and about 14.5 GHz. The transmitter waveguide section may also have a VSWR of equal to or less than 1.3:1. The transmitter waveguide section may have other electrical performance requirements such as power handling, insertion loss, return loss, and a rejection band.

A first port 58 of the receiver waveguide section 42 is integrally formed with a third port of the polarizer 44. A second port 62 of the receiver waveguide section 42 is integrally formed with the receiver circuit 26 of the outdoor unit 21. The receiver waveguide section 42 comprises a band pass filter 66 that is integrally formed as part of the receiver waveguide section 42. The band pass filter 66 attenuates signals not within a predefined receiver bandwidth, in order to prevent possible interference. The constructed embodiment of receiver waveguide section had a frequency of operation between about 10.95 GHz and about 12.75 GHz. The receiver waveguide section 42 may also have a VSWR of equal to or less than 1.3:1. The receiver waveguide section 42 may have other electrical performance requirements such as insertion loss, return loss, and a rejection band.

The TRIA 28 may have mechanical or environmental requirements depending on the particular application. Examples of mechanical requirements include but not limited to size, weight, mounting, and sealing. Examples of environmental requirements are but not limited to thermal, humidity, precipitation, exposure, altitude, absorption, reflection, vibration, and shock. The present invention may be used to meet these various requirements.

Figure 4:
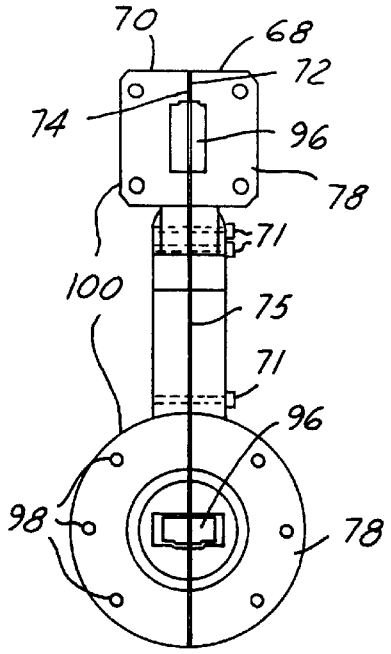
FIG. 4 is a side view of the TRIA that is coupled to receive and transmit circuits of the outdoor unit (ODU).
Figure 5:
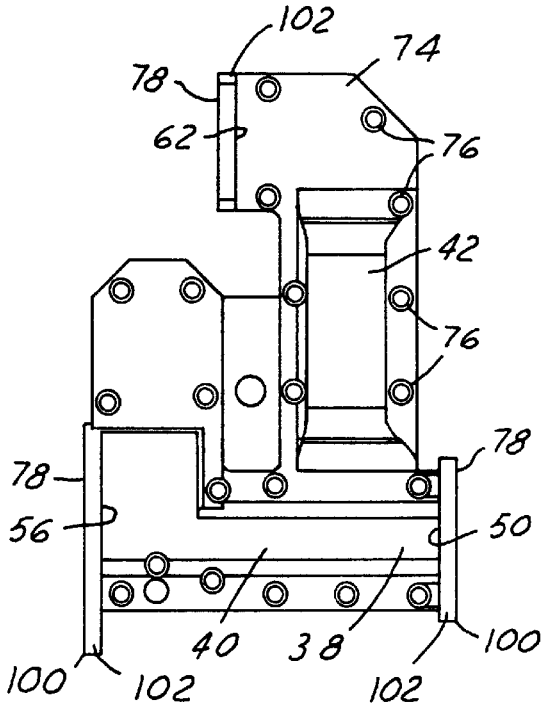
FIG. 5 is a front view of a mating surface corresponding to a half of the TRIA.
Figure 6:
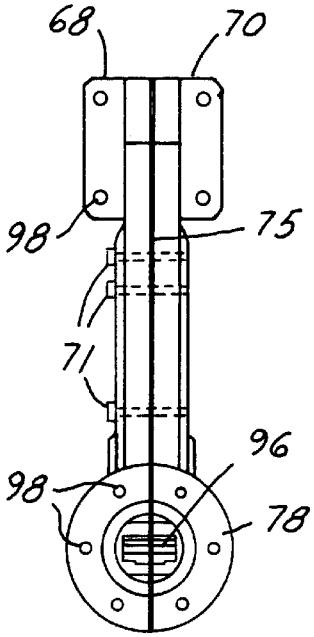
FIG. 6 is a side view of the TRIA that is coupled to an antenna comprised within the ODU.
Figure 7:
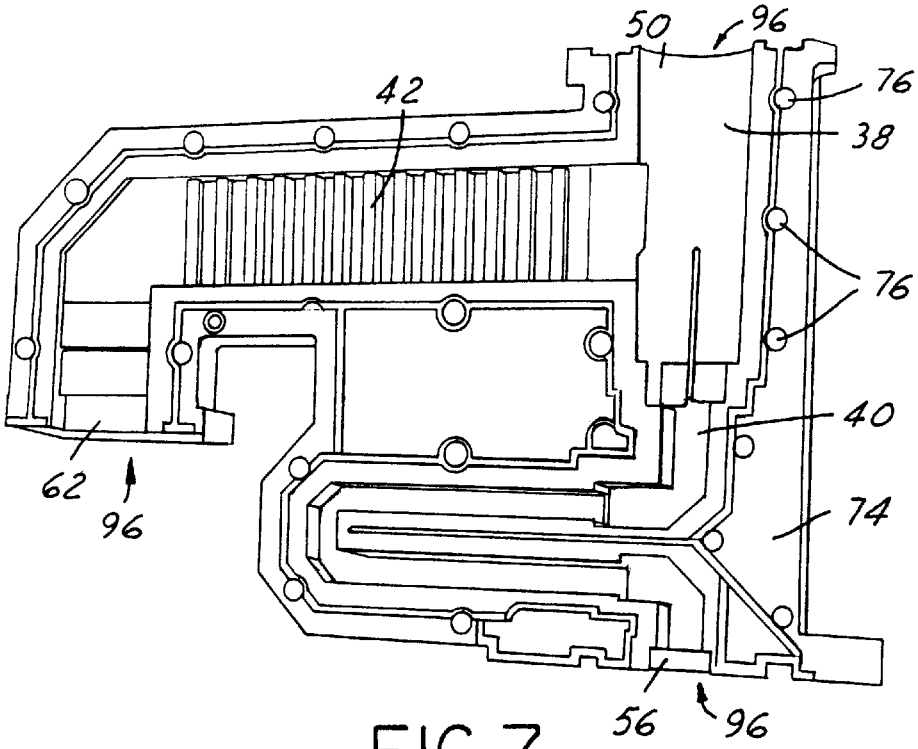
FIG. 7 is a perspective view of a half of the TRIA described in the present invention.

Referring now to FIGS. 4, 5, 6, and 7, several views of the TRIA 28 constructed according to the present invention are shown. The second port 50 of the circular waveguide section 38, the second port 56 of the transmitter waveguide section 40, and the second port 62 of the receiver waveguide section 42 are also shown. The circular waveguide section 38, the transmitter waveguide section 40, and the receiver waveguide section 42 are best shown in FIGS. 5 and 7. The TRIA 28 is comprised of an integrally manufactured and unitary first half 68 and an integrally manufactured and unitary second half 70. A first mating surface 72 of the first half 68 corresponds to a second mating surface 74 of the second half 70. The first mating surface 72 is a mirror image of the second mating surface 74.

In the present invention a gasket 75 is disposed between the first mating service 72 and the second mating surface 74. This is best shown in FIGS. 4 and 6. The gasket 75 may be made from a solid metallic material. The solid metallic material may be a thin preformed foil gasket made of a malleable material such as aluminum. Of course, the typical material may vary due to compatibility requirements with the waveguide material such as galvanic action.

The gasket 75 may also be made from an adhesive that may be conductive. In a constructed embodiment, a one-part conductive epoxy was used to form the gasket 75. The conductive epoxy used should be compatible with the material used to make the first half 68 and the second half 70 as to prevent corrosion. Silver beads or flakes are mixed with the epoxy to form a conductive epoxy resin. One commercially available epoxy meeting these requirements is Epoxyohm 97M-2™ from EpoxySet, Inc. This conductive epoxy forms an environmental moisture seal and allows for electrical conductivity between the first half 68 and the second half 70 of the manufactured TRIA 28. The conductive epoxy rectifies any variability or imperfections in the first mating surface 72 and the second mating surface 74 such as low spots, high spots, or "dimples". If conductivity between the first mating surface 72 and the second mating surface 74 is not required or is provided in some other way, nonconductive epoxy may be used to provide an environmental moister seal. Non-conductive epoxy can also provide the mechanical bond between the first half 68 and the second half 70 of the manufactured TRIA 28.

The first mating surface 72 and the second mating surface 74 shall seat properly as to meet strict interface and performance tolerances and to seal appropriately. For this reason the conductive epoxy is applied, preferably using an automatic stencil or screening machine, to the first mating surface 72 and the second mating surface 74. If an automatic stencil or screening machine is not available a manual stencil machine may be used. Automatic stencil or screening machines are commonly used in surface mount circuit board technology. This reduces labor costs and operator error, while increasing accuracy and efficiency.

Figure 8:
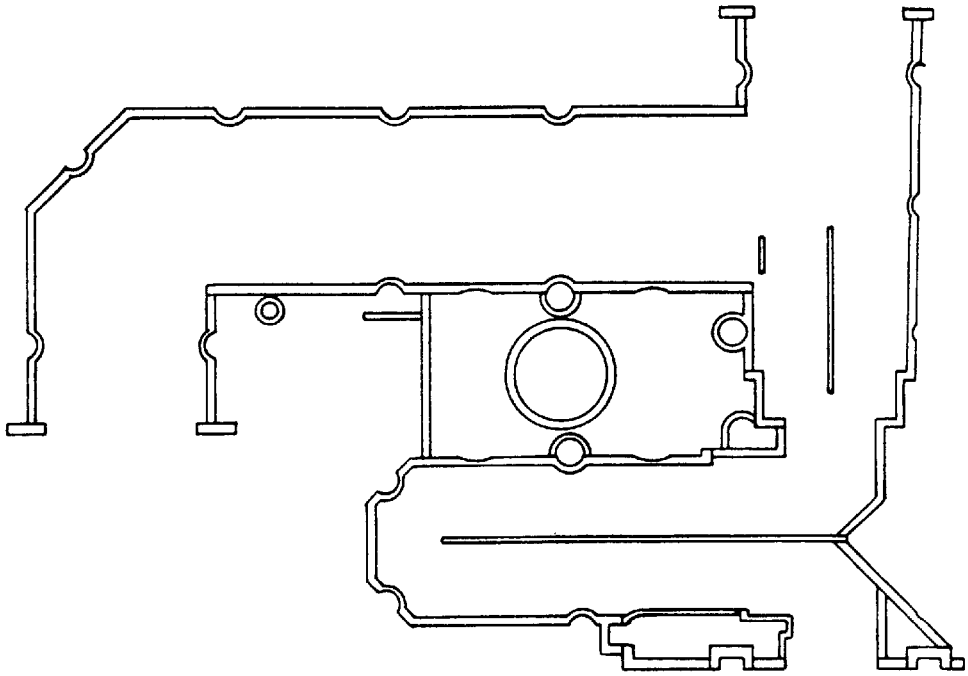
FIG. 8 is a block diagrammatic view of a stencil used in the present invention.

Referring now also to FIG. 8, a sample stencil pattern 77 for the present invention is shown. The stencil pattern 77 corresponds to the first mating surface 72 and the second mating surface 74. The conductive epoxy is applied to the first mating surface 72 in the pattern 77 of the stencil drawing shown.

The first half 68 is fastened to the second half 70 via fasteners 71 that extend through the fastener holes 76 in the first half 68 and corresponding fastener holes 76 in the second half 70. Various types of fasteners may be used to fasten the first half 68 to the second half 70, including screws. Fasteners 71 should allow seal to be formed between the first half 68 and the second half 70. The first half 68 fastened to the second half 70 form the TRIA 28.

Flange faces 78 may be shaped or sized in various ways including shapes meeting the WR-75 standard. The flange faces 78 and corresponding mating surfaces on three communication devices shall seat properly as to meet strict interface and performance tolerances. Therefore, the mating surfaces connecting the circular waveguide section 38 to the feedhorn 29, transmitter waveguide section 40 to the transmitter module 34, and the receiver waveguide section 42 to the LNB 36 shall seat properly. For this reason, the flange faces 78 of the TRIA 28 are machined using a lapping or machining process. The lapping and machining processes remove excess conductive epoxy located on the flange faces 78 and the flange O-ring groove 79.

Figure 9:
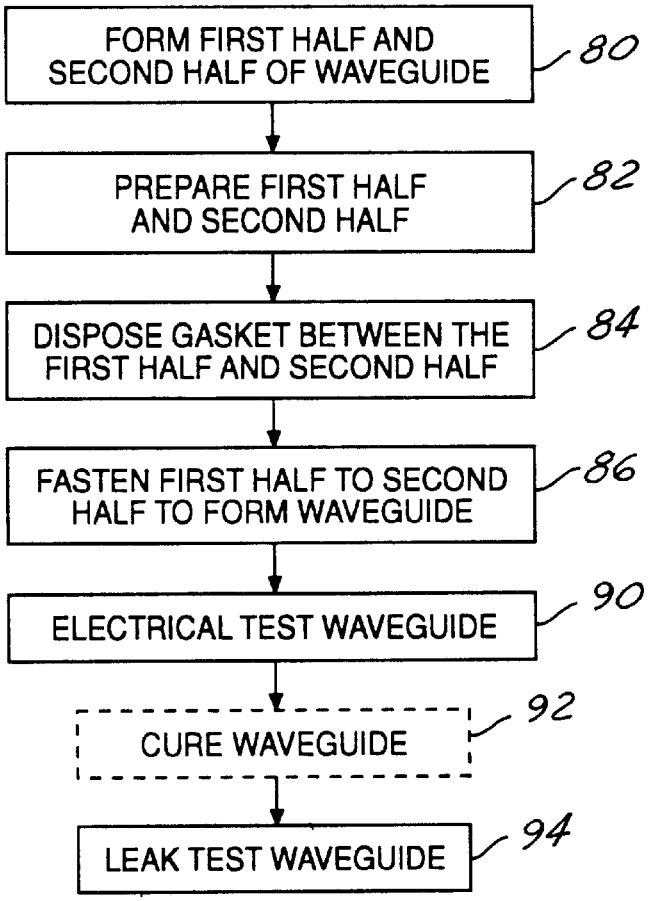
FIG. 9 is a flow chart illustrating a method, describing the assembling steps involved in the present invention.

Referring now to FIG. 9, in step 80, the first half 68 and the second half 70 are formed. The first half 68 and the second half 70 may be formed by any of the following processes but is not limited to molding, die-casting, stamping, or any other manufacturing processes. Another possible manufacturing process that may be used is one which the first half 68 and the second half 70 comprise a nonmetallic inner material, such as plastic, that is coated with a metal exterior. Semi-solid molding (SSM) is the preferred manufacturing process in forming the first half 68 and the second half 70. In semi-solid molding partially molten and solid material is formed in a mold.

In step 82, the first mating surface 72 and the second mating surface 74 are prepared. If a conductive epoxy is used then the first mating surface 72 and the second mating surface 74 are sanded or roughened using a scouring pad, for example SCOTCHBRITE™, or a similar material. Sanding the first mating surface 72 and the second mating surface 74 causes the mating surfaces to be slightly coarse. The slightly coarse first mating surface 72 and second mating surface 74 allow good adhesion combined with the conductive epoxy. However, it is important that the internal dimensions are not changed due to over sanding. It is common in manufacturing processes for a residue of grease or other oils to be present on the first mating surface 72 and the second mating surface 74. The mating surfaces are therefore degreased using preferably a two cycle cleaning bath with low or no residue detergent. If there are any remaining oils after the cleaning bath, they may be removed with alcohol wipes. After wiping with alcohol, the alcohol is allowed to air dry. During step 82, the operator is being careful not to put hand oils on the mating surfaces. In manufacturing processes it is also common for particles such as dirt or dust to land on components. Therefore, the first half 68 and the second half 70 are inspected to assure clean halves, no particles are inside the first half 68 and the second half 70 or on the mating surfaces, no corrosion or smutting is present on either half, and no flashing is on the mating surfaces that will not allow parts to come together completely.

In step 84, conductive epoxy may be applied to the first mating surface 68 and the second mating surface 70 of the TRIA 28 via the stenciling machine. The first half 68 and the second half 70 are put into the stenciling machine, one at a time, at the same time being careful not to touch the first mating surface 72 and the second mating surface 74. After a stencil or screen cycle, a visual inspection of the conductive epoxy on the casting is performed, to check for thin fill or missed areas. Multiple stencil or screen cycles are possible to fill thin or missing areas. The applied conductive epoxy is also visually inspected for inconsistencies.

In applications where an environmental moisture seal is not needed, a production method that utilizes the thin metal foil gasket to replace the conductive epoxy may be used. The thin metal gasket will provide the conductivity between the first half 68 and the second half 70 of the TRIA 28 while being malleable to rectify surface variability.

In step 86, the first half 68 and the second half 70 of the TRIA 28 are fastened together forming an electromagnetic waveguide component. A waveguide fixture (not shown) is used to hold the first half 68 and the second half 70 in an aligned position. The TRIA screws 71 are inserted into the holes and are torqued to 20-inch lbs. with a pneumatic screw feeding driver while following a waveguide torque sequence. The waveguide fixture should be designed to not cause epoxy smearing during assembling of the waveguide 26. All TRIA screw torques are checked using an electric driver calibrated to 20-inch lbs. After assembling the TRIA 28, excess conductive epoxy is removed on the inside of the TRIA 28 openings and inside the flange O-ring groove 79.

In step 90, the TRIA 28 is electrically tested. If the TRIA 28 does not meet the required data transmission specifications, "noncompliance", the TRIA 28 may be easily reworked because of the fact that the epoxy has not been cured. The position of the first half 68 in relation to the second half 70, the application of the conductive epoxy, and the castings of the first half 68 and the second half 70 may be reviewed during reworking of the TRIA 28.

In step 92, if conductive epoxy was used to form the gasket between the first half 68 and the second half 70, the TRIA 28 is put into an oven to bake at 150° C. for one hour to cure using the epoxy mentioned above. This provides a good conductive bond and moister seal between the first half 68 and the second half 70. Cure time may vary depending on oven size and TRIA 28 load. The TRIA 28 should reach 150° C. and then cure for an additional one hour. The flange faces 78, as in step 86, of the TRIA 28 are lapped/machined to remove excess epoxy. Also no burrs should be present in TRIA fastener holes 76, openings 96, flange holes 98, or flange edges 100. If an adhesive was used instead of a preformed gasket, then the flange faces 78 of the TRIA 28 are lapped or machined while holding waveguide flange 102 dimensions to drawing tolerances for acceptable electrical and mechanical performance and proper feedhorn 29 positioning.

In step 94, the TRIA 28 is leak tested. The openings 96 are plugged, and the TRIA is pressurized with air. The TRIA 28 is then checked for air leaks. If any air leaks are found the leaking areas of the TRIA 28 may be sealed with an anaerobic compound such as LOCTITE® 290.

The above-described invention rectifies variability and imperfections caused by manufacturing of the first half 68 and the second half 70 of the waveguide 26. The invention also provides a "quick" fix that allows easy reworking of the waveguide 26, in case of noncompliance, during assembly and testing of the waveguide 26. These benefits thereby reduce scrap, increase production yields, decrease labor costs, and provide a method to produce waveguides 26 in high production while maintaining strict performance requirements.

The above-described assembling method, to one skilled in the art, is capable of being adapted for various purposes and is not limited to the following applications: a ground based terminal, a satellite, or any other communication device that uses waveguide components. Waveguide components may include but are not limited to: antenna feeds, couplers, power splitters, switches, filters, orthomode transducers, hybrids, diplexers and polarizers. The above-described invention may also be varied without deviating from the true scope of the invention.

What is claimed is:

1. A method of assembling a waveguide having an electrically conductive first half and an electrically conductive second half, said method comprising the steps of:

applying an electrically conductive gasket to a first mating surface of said first half; and fastening said second half to said first half, so that said gasket is disposed between a first mating surface of said first half and a second mating surface of said second half.

2. A method as in claim 1 further comprising the steps of:

cleaning said first half before the step of applying said gasket; and cleaning said second half before the step of applying said gasket.

3. A method as in claim 1 wherein the step of applying said gasket comprises the step of applying a preformed metallic gasket.

4. A method as in claim 1 wherein the step of applying said gasket comprises the step of applying an electrically conductive gasket.

5. A method as in claim 1 wherein the step of applying said gasket forms a mechanical bond between said first half and said second half.

6. A method as in claim 1 wherein the step of applying said gasket comprises the step of applying a first layer of adhesive to said first mating surface of said first half.

7. A method as in claim 6 further comprising the step of applying a second layer of adhesive to said first mating surface of said first half.

8. A method as in claim 7 wherein the step of applying a first layer of said adhesive to said first mating surface of said first half comprises the step of applying said adhesive by stenciling or screening.

9. A method as in claim 6 wherein the step of applying a first layer of said adhesive comprises the step of applying a first layer of an epoxy.

10. A method as in claim 6 further comprising the step of applying said adhesive to a second mating surface of said second half.

11. A method as in claim 10 further comprising the step of curing said adhesive to said first mating surface of said first half and to said second mating surface of said second half.

12. A method as in claim 11 wherein the step of curing comprises the step of forming a moisture seal between said first mating surface of said first half and said second mating surface of said second half.

13. A method as in claim 6 further comprising the step of machining flange faces on said waveguide.

14. A method as in claim 1 further comprising the steps of:

cleaning said first half after applying said gasket; and cleaning said second half after applying said gasket.

15. A waveguide formed according to method of claim 1.

16. A method of assembling a waveguide having an electrically conductive first half and an electrically conductive second half, said method comprising the steps of:

applying an electrically conductive epoxy to a first mating surface of said first half by a stencil or a screen machine;

positioning said epoxy between said first mating surface of said first half and said second mating surface of said second half;

fastening said second half to said first half to form the waveguide; and curing said epoxy.

17. A method as in claim 16 wherein prior to the step of applying, further comprising the steps of:

cleaning a first mating surface of said first half; and cleaning a second mating surface of said second half.

18. A method as in claim 16 wherein the step of curing comprises the step of curing said epoxy to form a moisture seal between said first mating surface of said first half and said second mating surface of said second half.

19. A method as in claim 16 further comprising the step of machining a flange face after the step of curing.

20. A method as in claim 16 wherein prior to the step of curing, further comprises the step of electrically testing the waveguide.

21. A method as in claim 20 further comprises the step of reworking said first half and said second half of the waveguide wherein said step of electrically testing indicates noncompliance.

22. A method as in claim 21 wherein said step of reworking comprises removing said epoxy, reapplying said epoxy, or repositioning said first mating surface relative to said second mating surface.

23. A waveguide comprising:

an electrically conductive first half having a first mating surface;

an electrically conductive second half having a second mating surface fastened to said first half so that said first mating surface is aligned with said second mating surface; and an electrically conductive gasket disposed between said first mating surface of said first half and said second mating surface of said second half.

24. A waveguide as in claim 23 wherein said gasket comprises an adhesive epoxy.

25. A waveguide as in claim 23 wherein said gasket comprises a preformed metallic gasket.

* * * * *